United States Patent [19]

Le Donne

[11] Patent Number: 4,961,227

[45] Date of Patent: Oct. 2, 1990

[54] PORTABLE LOUD SPEAKER SYSTEM

[76] Inventor: Robert D. Le Donne, 9707 Ross Station Rd., Sebastopol, Calif. 95472

[21] Appl. No.: 414,126

[22] Filed: Sep. 28, 1989

[51] Int. Cl.[5] ..... H04R 5/02

[52] U.S. Cl. ..... 381/24; 381/162; 381/25; 381/90; 181/161

[58] Field of Search ..... 381/162, 161, 188, 205, 381/24, 25, 204, 88, 89, 90; 181/126, 161

[56] References Cited

U.S. PATENT DOCUMENTS

| | | | |
|---|---|---|---|
| 3,423,544 | 1/1969 | Weiss | 381/153 |
| 4,064,376 | 12/1977 | Yamada | 381/152 |
| 4,750,208 | 6/1988 | Yamada et al. | 381/162 |
| 4,757,548 | 7/1988 | Fenner, Jr. | 381/151 |

*Primary Examiner*—Forester W. Isen

*Attorney, Agent, or Firm*—Flehr, Hohbach, Test, Albritton & Herbert

[57] ABSTRACT

A portable speaker having a speaker housing which vibrates in harmony with the audible sounds generated by the speaker. The speaker includes a loud speaker housing having a surface capable of vibrating and a speaker cone which vibrates within said housing to generate audible sound during the speaker's operation. A propagation member which has a first contact surface in contact with the speaker cone, and a second contact surface which is in contact with the vibration surface of the speaker housing is responsible for transmitting the cone vibrations to the housing surface. The transmitted vibrations causes the surface to vibrate in harmony with the audible sounds created by the speaker.

21 Claims, 2 Drawing Sheets

PORTABLE LOUD SPEAKER SYSTEM

The present invention relates generally to a vibration loud speaker system that both produces audible sounds and vibrations that can be felt by a user. More particularly, the present invention relates to such a speaker system in portable form having a speaker housing which vibrates in harmony with the audible sounds generated by the speaker.

BACKGROUND OF THE INVENTION

Loud speaker drivers include the following components: an electromagnet; a moving voice coil; and a speaker cone attached to the coil. The speaker driver components operate together to generate audible sounds, such as music or voice transmissions. The electromagnet receives sound transmissions in the form of electrical signals from a sound amplifier. The variations in the signal frequency and amplitude causes the magnetic flux of the magnet to change in response thereto. The moving voice coil and the speaker cone, responsive to the changes in magnetic flux, move in a manner characteristic of the frequency and amplitude of the signal.

The speaker cone is the actual component which is responsible for converting the electrical signals into audible sound. The movement of the cone displaces the air in the vicinity of the cone. The displaced air creates sound waves having an amplitude and frequency indicative of those from the electrical signal, and in this manner, the desired audible sound reproduction is achieved.

The loud speaker drivers are enclosed in a sturdy, nonvibrational housing. The electromagnet and voice coil are recessed into the housing and the face of the cone is generally focused outward from the housing to direct the audible sound outward into the listening area. A perforated grill made of a rigid material, such as plastic or metal, or an acoustically transparent foam is placed over the exposed surface of the cone to protect it.

It is known in the audio reproduction art that the transmissions of vibrations to the body intensifies the enjoyment of listening to music. For example, in U.S. Pat. No. 4,064,376 and U.S. Pat. No. 4,354,067 two devices for the implantation of an vibration device within a the seat and backrest respectively of a chair are disclosed. The audio sensation created by the vibrations transmitted through the body cavity of the person sitting in the chair intensifies the enjoyment of the music. In U.S. Pat. No. 4,757,548, a speaker which transmits sonic vibrations to liquid and solid media is disclosed. U.S. Pat. No. 4,778,027 teaches the placement of speakers faced toward a surface to be vibrated. During operation, the sonic energy generated by the speaker is transmitted to the surface causing it to vibrate.

It is also known in the audio reproduction art to use sound induced vibrations to aid the hearing impaired. In U.S. Pat. Nos. 3,423,544 and 2,858,376 respectively, two electro-acoustic bone conduction receivers mounted onto the elongated portion of eye glasses are disclosed. The bone conduction receiver as described in both of these references is an electro-mechanical device which transforms electric currents into mechanical vibrations and transmits the latter to the bones of the skull of the wearer of the glasses in the vicinity of the ear. This process of transmitting sounds to the inner ear of a deaf person is known to give good results in many instances where the inner ear is in reasonably good condition, although the middle ear may be seriously defective.

The prior art, however, does not provide for a small, lightweight loud speaker having a speaker housing which vibrates in harmony with the audible sounds created by the speaker to transmit vibrations to a bodily appendage, such as the palm of the hand.

SUMMARY OF THE INVENTION

Accordingly, it is a primary object of the present invention to provide a portable, lightweight loud speaker having a speaker housing which vibrates in harmony with the audible sounds created by the loud speaker and which is adapted to be held in the palm of one's hand and to transmit music vibrations thereto. As used herein, the term "vibrates in harmony" refers to vibrations at the same frequency as the audible sounds or some other frequency related to the frequency of the audible sounds, which varies as the frequency of the audible sounds varies.

To achieve the foregoing and other objects in accordance with the purpose of the present invention, there is provided a portable loud speaker system. Each speaker in the system includes a loud speaker housing having a surface capable of vibrating and a speaker cone which vibrates within the housing to generate audible sound during the speaker's operation. A propagation member which has a first contact surface in contact with the speaker cone, and a second contact surface which is in contact with the vibration surface of the speaker housing is positioned for transmitting the cone vibrations to the housing surface. The transmitted vibrations causes the surface to vibrate in harmony with the audible sounds created by the speaker.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
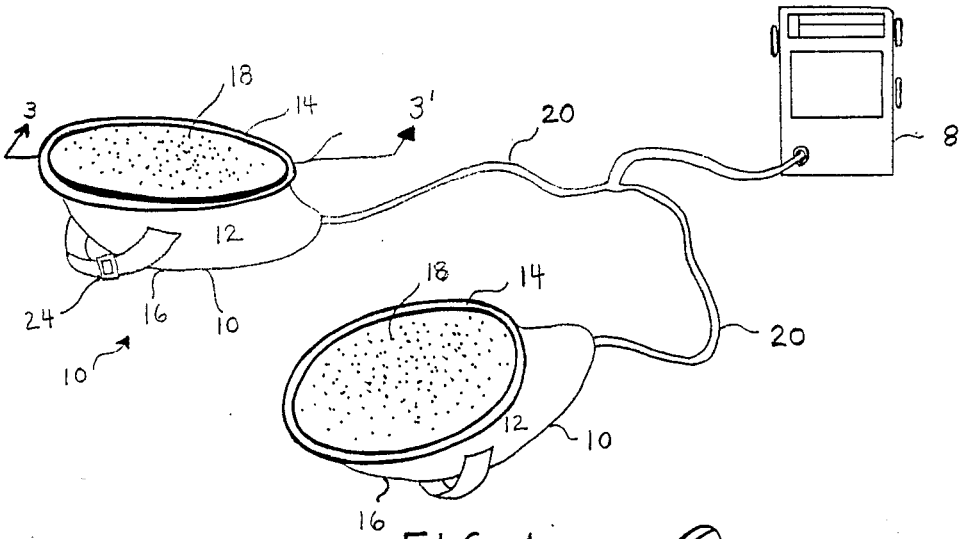
FIG. 1 is a perspective view of two light weight stereo loud speakers connected to a portable sound amplifier according to one embodiment of the present invention.

Reference is initially made to FIG. 1 which shows a perspective view of a two light weight stereo loud speaker housings connected to a portable sound amplifier according to one embodiment of the present invention. The present invention is best employed when used with a pocket stereo amplifier and/or tape player 8 such as a Sony "Walk Man" (which is a registered trademark of the Sony Corporation) unit so as to take advantage of the portable, light weight nature of the speakers. However, the loud speakers of the present invention could be used with any stereo or sound amplifier.

Each speaker 10 includes a semi-circular shaped housing 12 having a flat front face 14 and a curved shaped back 16. The housing is made of a rigid material, such as plastic, wood or the like. A perforated grill 18, also made from a rigid material, such as plastic or metal, is used to cover flat front face 14 of the housing. A speaker wire 20 is responsible for transmitting electrical audio signals to a loud speaker driver (not shown) enclosed inside the housing 12 and covered by grill 18. An adjustable elastic band 24 fastened to the housing 12 is used to secure the speaker to a bodily appendage of the person using the speaker system.

Figure 2:
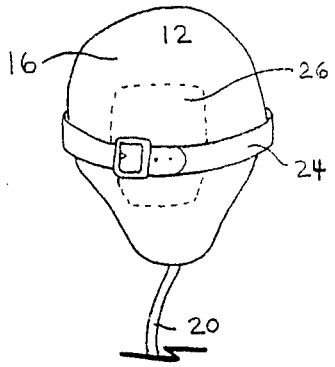
FIG. 2 is a back view of the housing of one of the speakers shown in FIG. 1 according to the present invention.

Referring now to FIG. 2, back 16 of housing 12 of the speaker of FIG. 1 is shown. This view of the speaker reveals the smoothed, curved shaped back portion of the back of the speaker having a vibration surface 26. The curved back portion 16 allows the back of the speaker 10 to fit comfortably into the hand with the vibrational surface 26 resting on the palm. With an adjustment of band 24, speaker housing 12 and especially surface 26 is comfortably secured to the user's palm.

Figure 3:
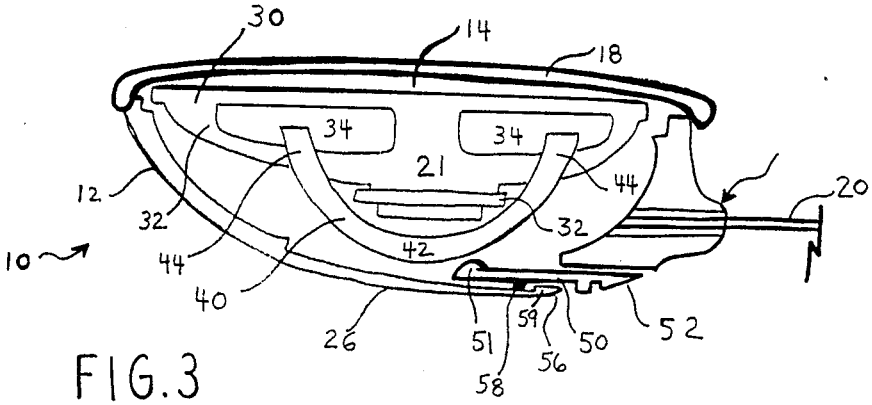
FIG. 3 is a cross-section view of one of the speakers of FIG. 1 taken along the 3—3' axis and showing the speaker driver and vibrational mechanism inside the housing.

Referring now to FIG. 3, the speakers of housing 12 and speaker driver 21 and the mechanism which causes surface 26 to vibrate internal to the housing is shown. Speaker driver 21 includes a structural frame 30, a magnet 32, a conventional moving voice coil (not shown) and a cone 34. Driver 21 is situated within the housing 12 so that cone 34 is focused outward to direct audible sound through grill 18 of housing 12. The remainder of the driver, including magnet 32 and the voice coil are recessed within housing 12. Cone 34 is made of paper, polypropylene or any other material suitable for sound reproduction.

The mechanism which causes surface 26 to vibrate is a "U" shaped member 40 having a central curved "U" section 42 and two end sections 44. Member 40 is designed to fit between the underside of speaker cone 34 and to rest upon surface 26. End sections 44 provide a contact point between "U" member 40 and cone 34 and are affixed by a glue, epoxy or other fastening means to the underside of cone 34. Portion 42 provides a contact surface between the member and surface 26. When cone 34 vibrates during speaker operation, member 40 propagates the cone vibrations to surface 26. Accordingly, section 26 of speaker housing 12 vibrates in harmony with the audible sounds generated by the speaker driver 40.

An elongated member 50 with a wedge like structure 51 located at one end and a thumb grip 52 at the other end of the member is provided as a means for the user to prevent section 26 of the housing from vibrating when desired. Elongated member 50 is designed to snugly fit inside and to slide in and out of a small recess 56 in housing 12 so that wedge like structure 51 is located inside housing 12 and the thumb grip 52 is located external the housing. When the user would like to prevent section 26 from vibrating, thumb grip 52 is grasped and pushed inward so that wedge like structure 51 is forced between member 40 and section 26. This separates the contact surface between the two and prevents section 26 from vibrating. Alternatively, when the user desires section 26 to vibrate, thumb grip 52 is grasped and pulled out causing wedge like structure 51 to become un-wedged between member 40 and surface 26. Member 40 is therefore in contact with surface 26 and is capable of directly propagating vibrations from the cone 34 to the surface without obstruction.

A catch 58 located on the underside of elongated member 50 projects downward. A stop 59 on the housing located adjacent the recess 56 projects upward, and acts in cooperation with catch 58 to limit the outward movement of member 50.

Figure 4:
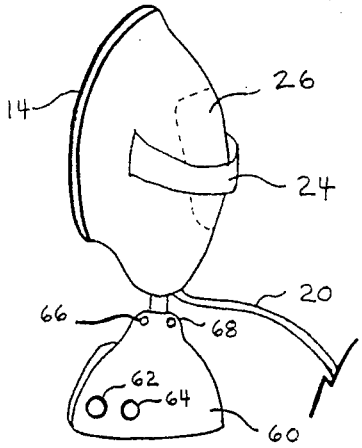
FIG. 4 is a perspective view of one of the speakers as shown in FIG. 1 electro-mechanically mounted on a base containing a sound amplifier according to yet another embodiment of the present invention.
Figure 5:
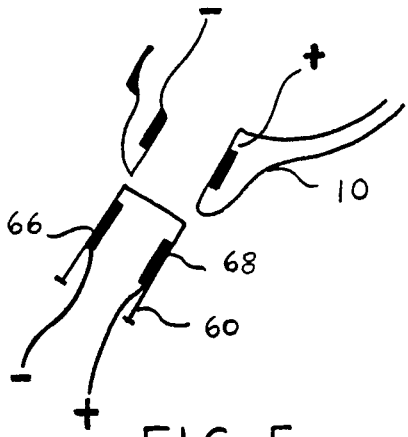
FIG. 5 is an exploded view of the electro-mechanical connection between the speaker and base as shown in FIG. 4.

FIG. 4 is a perspective view of one of the two loud speakers as shown in FIG. 1 mounted on a base 60 according to another use of the present invention. Base 60 may contain a sound amplifier and appropriate sound amplification controls, such as volume control 62 and on/off control 64. Two contacts 66 and 68 jointly located on top of base 60 electro-mechanically connect and support the amplifier to the speaker 10. Referring now to FIG. 5, an exploded view of the electro-mechanical connectors 66 and 68 are shown.

Figure 6:
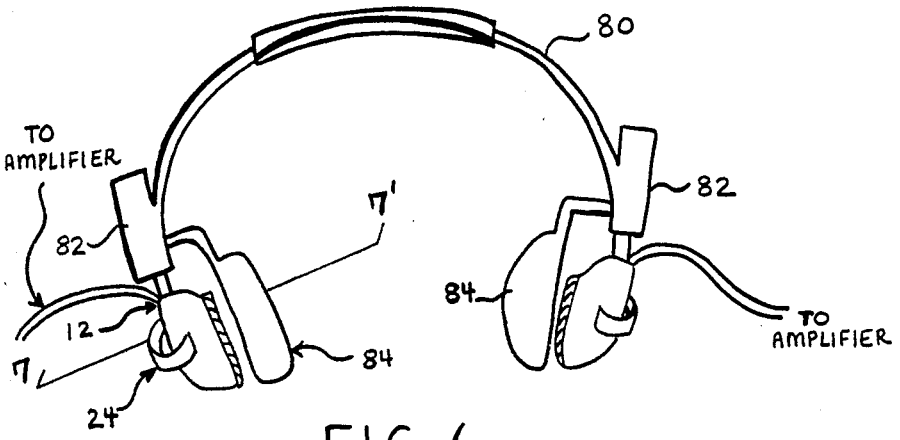
FIG. 6 is a perspective view of the vibrational speaker for use with a stereo headset as shown.

Referring now to FIG. 6, a perspective view of the vibrational speaker for use within a stereo headset is shown. The headset includes a head band 80 and pair of posts 82 for mechanically connecting each speaker 10 to the head band. An ear pad 84 is secured to the speaker housing 12 and is engaged to fit in-between speaker housing 12 and the ear when the headset is in use. The ear pad 84 includes a soft, foam like material shaped to circumscribe and encompass the ear so as to provide an acoustically desirable environment around the ear.

Figure 7:
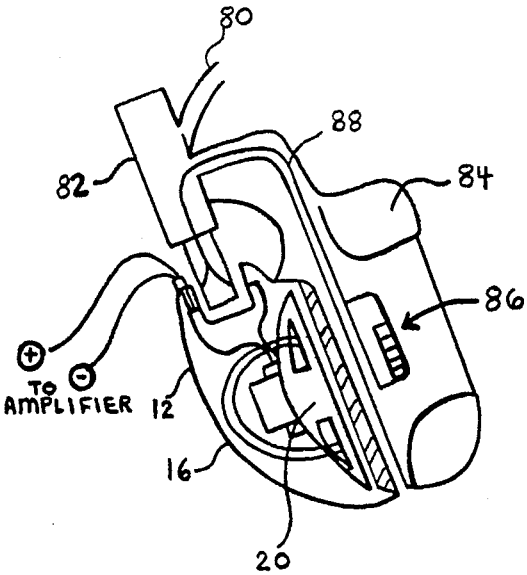
FIG. 7 is a cross section view of one of the speakers of FIG. 1 taken along the 6—6' axis and showing the speaker driver and vibrational mechanism inside the housing.

Referring now to FIG. 7, a miniature speaker 86, driven by amplifier 8 via speaker wire 88, is implanted within ear pad. Speaker 86 is engaged to rest adjacent the ear canal of the listener. The speaker combination including speaker 10 and miniature speaker 86 act together to amplify the sound for the listener.

While the present invention has been described with reference to a few specific embodiments, the description is illustrative of the invention and is not to be construed as limiting the invention. Various modifications may be made to those skilled in the art without departing from the true spirit and scope of the invention as defined by the appended claims.

What is claimed is:

1. A speaker having a speaker housing which vibrates in harmony with the audible sounds created by the speaker, the speaker comprising:

a loud speaker housing having a vibratable surface;

a speaker cone which vibrates within said housing to generate audible sound during said speaker's operation;

a propagation member having a first contact surface in contact with said speaker cone, and a second contact surface in contact with said vibratable surface of said speaker housing, said member propagating said cone vibrations to said vibratable surface causing vibratable surface to vibrate in harmony with the audible sounds created by the speaker.

2. The speaker of claim 1 wherein said propagation member is a "U" shaped member having a curved section and two end sections.

3. The speaker of claim 2 wherein said curved section of said member forms said second contact surface in contact with said vibratable surface.

4. The speaker of claim 2 wherein said two end sections form said first contact surface in contact with said speaker cone.

5. The speaker of claim 1, further comprising:

an adjustable sliding member engaged to selectively slide in between said propagation member and said vibratable surface to prevent said vibratable surface from vibrating.

6. The speaker of claim 1, in which said housing is shaped to fit against a bodily appendage of a user.

7. The speaker of claim 6, wherein a strap is configured and positioned to be wrapped around the hand of the user so the loud speaker can be secured to the palm of the hand.

8. The speaker of claim 1, wherein said speaker is electrically connected to a portable sound amplifier.

9. The speaker of claim 1, wherein said speaker is electrically and mechanically connected to a sound amplifier base.

10. The speaker of claim wherein said loud speaker housing is attached to a head set.

11. The speaker attached to a head set of claim 10, further comprising:

a miniature speaker;

an ear pad supported by said head set and adapted to fit between said loud speaker housing and the ear of the user, said pad holding said miniature speaker adjacent to the ear canal of the user.

12. A stereo speaker system having two loud speakers, wherein each speaker has a housing which vibrates in harmony with the audible sounds created by the speaker, each speaker comprising:

a loud speaker housing having a vibratable surface;

a speaker cone which vibrates within said housing to generate audible sound during the speaker's operation;

a propagation member having a first contact surface in contact with said speaker cone, and a second contact surface in contact with said vibratable surface of said speaker housing, said member propagating said cone vibrations to said vibratable surface causing said vibratable surface to vibrate in harmony with the audible sounds created by the speaker.

13. The speaker system of claim 12 wherein said propagation member is a "U" shaped member having a curved section and two end sections.

14. The speaker system of claim 13 wherein said curved section of said member forms said second contact surface in contact with said vibratable surface.

15. The speaker system of claim 14 wherein said two end sections form said first contact surface in contact with said speaker cone.

16. The speaker system of claim 12, further comprising:

an adjustable sliding member engaged to selectively slide in between, said propagation member and said vibratable surface to prevent said vibratable surface from vibrating.

17. The speaker system of claim 12, further comprising an adjustable elastic strap affixed to the speaker housing to secure said speaker to a bodily appendage of the user.

18. The speaker system of claim 12, wherein said strap is configured and positioned to be wrapped around the hand of the user so the loud speaker can be secured to the palm of the hand.

19. The speaker system of claim 12, wherein the speakers are electrically connected to a portable sound amplifier.

20. The speaker system of claim 12, wherein the loud speaker housings are engaged to a head set.

21. The speaker attached to said head set system of claim 20, further comprising:

a miniature speaker;

an ear pad supported by said head set and adapted to fit between a loud speaker and the ear of the user, said ear pad holding said miniature speaker adjacent to the ear canal of the user.

* * * * *

UNITED STATES PATENT AND TRADEMARK OFFICE
CERTIFICATE OF CORRECTION

PATENT NO. : 4,961,227

DATED : October 2, 1990

INVENTOR(S) : Robert D. LeDonne

It is certified that error appears in the above-identified patent and that said Letters Patent is hereby corrected as shown below:

The title page, showing the illustrative figure, should be deleted to be replaced with the attached title page.

Signed and Sealed this

Seventh Day of January, 1992

*Attest:*

HARRY F. MANBECK, JR.

*Attesting Officer*

*Commissioner of Patents and Trademarks*

United States Patent [19]

Le Donne

[11] Patent Number: 4,961,227

[45] Date of Patent: Oct. 2, 1990

[54] PORTABLE LOUD SPEAKER SYSTEM

[76] Inventor: Robert D. Le Donne, 9707 Ross Station Rd., Sebastopol, Calif. 95472

[21] Appl. No.: 414,126

[22] Filed: Sep. 28, 1989

[51] Int. Cl.[5] ..... H04R 5/02

[52] U.S. Cl. ..... 381/24; 381/162; 381/25; 381/90; 181/161

[58] Field of Search ..... 381/162, 161, 188, 205, 381/24, 25, 204, 88, 89, 90; 181/126, 161

[56] References Cited

U.S. PATENT DOCUMENTS

| | | | |
|---|---|---|---|
| 3,423,544 | 1/1969 | Weiss | 381/153 |
| 4,064,376 | 12/1977 | Yamada | 381/152 |
| 4,750,208 | 6/1988 | Yamada et al. | 381/162 |
| 4,757,548 | 7/1988 | Fenner, Jr. | 381/151 |

*Primary Examiner*—Forester W. Isen
*Attorney, Agent, or Firm*—Flehr, Hohbach, Test, Albritton & Herbert

[57] ABSTRACT

A portable speaker having a speaker housing which vibrates in harmony with the audible sounds generated by the speaker. The speaker includes a loud speaker housing having a surface capable of vibrating and a speaker cone which vibrates within said housing to generate audible sound during the speaker's operation. A propagation member which has a first contact surface in contact with the speaker cone, and a second contact surface which is in contact with the vibration surface of the speaker housing is responsible for transmitting the cone vibrations to the housing surface. The transmitted vibrations causes the surface to vibrate in harmony with the audible sounds created by the speaker.

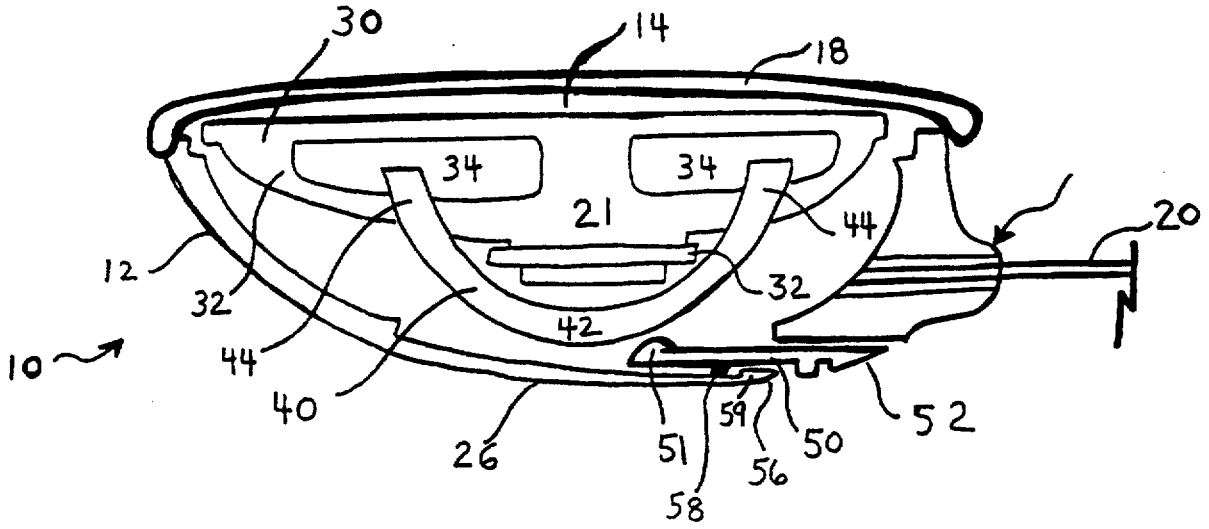

21 Claims, 2 Drawing Sheets